US006381874B1

(12) United States Patent
Floyd

(10) Patent No.: US 6,381,874 B1
(45) Date of Patent: May 7, 2002

(54) TUMBLER FOR CLOTHES DRYER

(75) Inventor: Michael T. Floyd, Winnebago, WI (US)

(73) Assignee: Continental Girbau, Inc., Oshkosh, WI (US)

( * ) Notice: Subject to any disclaimer, the term of this patent is extended or adjusted under 35 U.S.C. 154(b) by 0 days.

(21) Appl. No.: 09/689,918

(22) Filed: Oct. 13, 2000

(51) Int. Cl.[7] ..... F26B 11/02
(52) U.S. Cl. ..... 34/602; 34/250
(58) Field of Search ..... 34/133, 250, 602

(56) References Cited

U.S. PATENT DOCUMENTS 4,007,546 A * 2/1977 Sauer ..... 34/133
5,062,219 A * 11/1991 Harris et al. ..... 34/133
5,416,983 A * 5/1995 Moser ..... 34/250
5,495,681 A * 3/1996 Paradis ..... 34/602
5,901,465 A * 5/1999 Boussetta et al. ..... 34/602

* cited by examiner

*Primary Examiner*—Teresa Walberg
*Assistant Examiner*—Leonid M Fastovsky
(74) *Attorney, Agent, or Firm*—R. Jonathan Peters

(57) ABSTRACT

A clothes dryer including a housing having a horizontally disposed substantially cylindrical tumbler open at one end only. The wall of the cylinder is reticulated, and is formed of galvanized steel. The end of the bucket opposite to the open end is provided with a stainless steel sheet backing having a substantially mirror-like finish as viewed from the forward or open end.

4 Claims, 3 Drawing Sheets

TUMBLER FOR CLOTHES DRYER

FIELD OF THE INVENTION

This invention relates to a clothes dryer. In its more specific aspect, this invention relates to a tumbler or cylinder for a commercial clothes dryer having components of different types of steel.

BACKGROUND

A typical commercial clothes dryer, including gas-fired, electric heated, and steam heated, comprises a housing of substantially rectangular configuration for holding such things as the motor, piping, duct work, valving, and the like, essential for the operation of the dryer. The central feature of the dryer in so far as the consumer or end user is concerned is the cylinder, sometimes referred to as the basket or tumbler, which is substantially cylindrical and horizontally disposed in the housing. In operation, the cylinder rotates about its central horizontal axis. The front end or forward end of the tumbler is open, and a door, which is hingedly mounted on the housing, provides access to the cylinder. A glass window in the door, known as the door glass but may be plastic rather than glass, allows the consumer to view the tumbler and its contents. The load capacity for the cylinder of a commercial clothes dryer may range from about 30 pounds to about 200 pounds, most typically being about 30–75 pounds, and the tumbler may measure from about 30–40 inches in diameter and about 30–40 inches deep.

The basket or cylinder is substantially cylindrical configuration having a reticulated or open network wall. A plurality of vanes or ribs, usually four, are radially disposed in the tumbler and extend for a short distance from the interior of the wall, The cylinder is closed at the rear or back with a steel sheet. The tumbler, including the vanes and backing, are made of galvanized steel, or galvalume, which enhances the wear and inhibits the corrosion of the base metal, e.g., steel. However, the finishing on the base metal, i.e., galvanizing, detracts considerably from the appearance, which is a negative to the consumer or user. Because the cylinder wall is reticulated, the largest surface area is the steel backing, and the eye focuses largely on this backing. Moreover, although the finishing on the base metal, such as the galvanizing, enhances the properties of the steel, it nevertheless has its limitations as to heat conductivity and corrosion resistance. This is particularly true with clothes dryers that operate at elevated temperatures. Also, harsh chemicals used in the laundering of clothes frequently are not adequately or completely rinsed from the clothes, and when placed in the dryer, these chemicals attack the finish coating and the steel. As a consequence, the backing in particular, which has the larger surface area and receives the brunt of the impact, will deteriorate faster and therefore lose its appeal to the consumer or end user.

This invention has therefore as its purpose to provide in a clothes dryer a cylinder exhibiting improved heat conductivity and corrosion resistance, and yet maintain its aesthetic appeal.

SUMMARY OF THE INVENTION

Broadly, my invention provides a clothes dryer comprising a housing having a horizontally disposed substantially cylindrical tumbler or basket arranged in the housing so as to be rotatable about its center longitudinal axis. The wall of the cylinder is reticulated, and a plurality of vanes or ribs extend radially from the interior of the wall for a short distance to facilitate tumbling of the clothes. This part of the cylinder is formed of a galvanized steel, such as a cold rolled steel with a galvanized coating, but it should be understood that the term "galvanize" or "galvanizing" as used herein and in the appended claims is not limited to a zinc coating, but may include other zinc alloy coatings. The cylinder has a forwardly disposed open end, and a door is hingedly mounted to the housing to allow access to the cylinder at the open end. The oppositely disposed end of the bucket, that is the end opposite to the open end, is provided with a stainless steel sheet having a substantially mirror finish as viewed from the forward and.

The backing is comprised of a stainless steel sheet having at least about 12 percent by weight chromium, preferably about 14 to 18 percent by weight, but the total chromium can vary depending upon other alloying elements. For any such tumbler, the surface area is predominantly that of the stainless steel backing, because the reticulated wall is an open network or a perforated wall, and therefore the metal network has a smaller surface area. The stainless steel backing is provided with a substantially mirror finish, so that when one looks into the basket or through the glass of the door, the eye will focus on the bright surface. Further, the stainless steel sheet, or chrome steel sheet, is at least about 22 gauge, but the gauge for the sheet can vary depending upon such factors as the size of the cylinder, the temperature of operation, and the life expectancy for the cylinder. Also, the back sheet typically receives the brunt of the impact from the clothes in the dryer, and the sheet must be of sufficient thickness to resist impact without deforming permanently.

BRIEF DESCRIPTION OF THE DRAWINGS

The invention and its advantages will be more readily understood by reference to the following detailed description and exemplary embodiments when read in conjunction with the following drawings, wherein.

DETAILED DESCRIPTION OF THE INVENTION AND PREFERRED EMBODIMENTS

Figure 1:
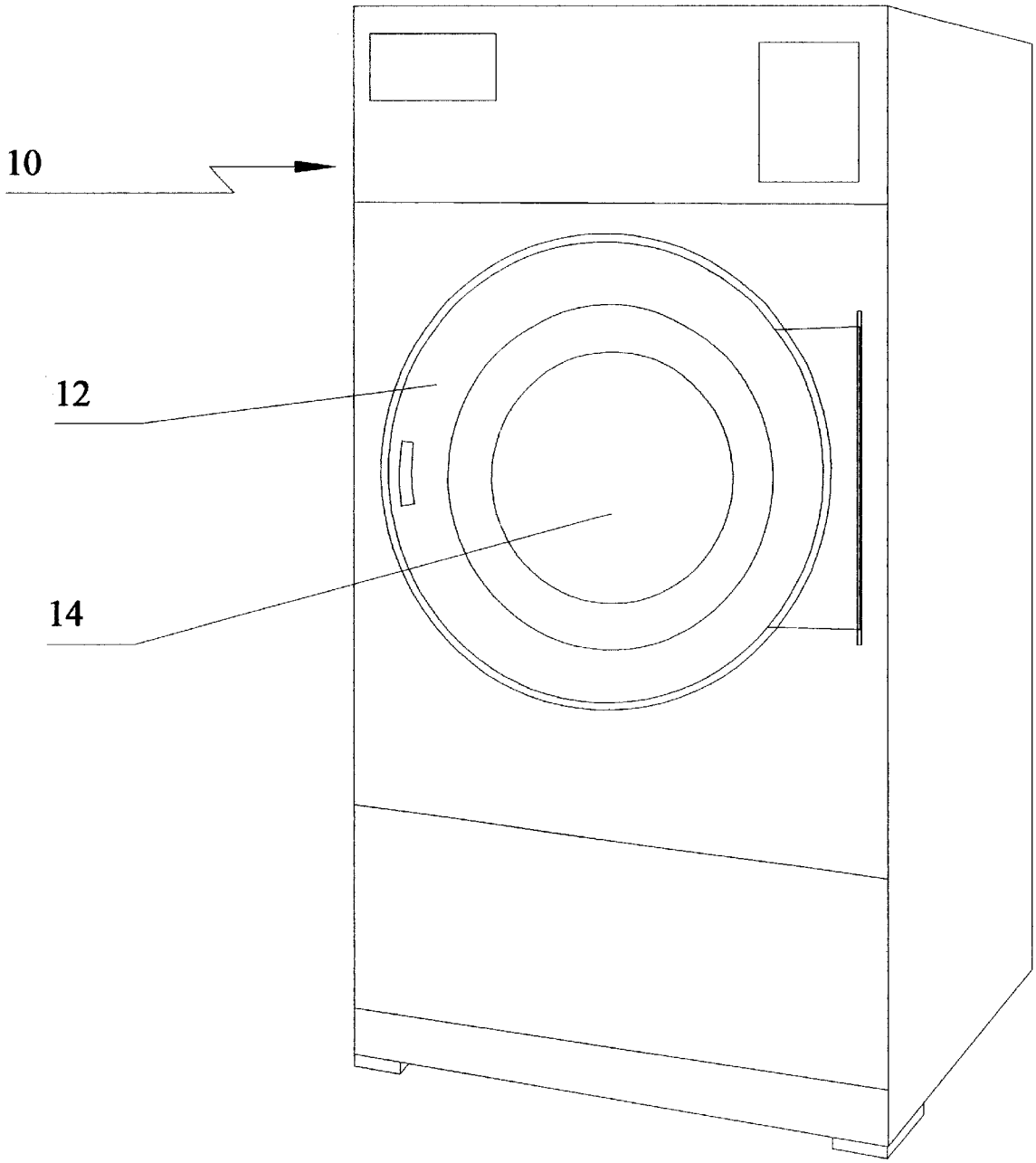
FIG. 1 is a perspective view as seen from the front of a typical commercial clothes dryer.

Referring to the drawings wherein the same reference numerals refer to similar parts throughout the various views, there is shown in FIG. 1 a clothes dryer assembly, indicated generally at 10, as might be installed in a commercial operation, and utilizing the bucket or cylinder of my invention. It will be observed that the over-all geometry of the dryer is of a generally rectangular configuration to provide a box-like structure, and the housing is most typically metal. The piping, duct work, electrical connections, and the like, have been omitted. In a typical installation for a commercial operation, e.g., self-service laundries, hotels, and hospitals, the clothes dryer is inclined so as to be elevated at the forward end relative to the back end. The difference in elevation is usually about one inch, which creates a slight difference in elevation so that the front of the dryer is slightly elevated at the front. The reason for sloping the dryer to the rear is that during the drying cycle the clothes will be thrust to the rear of the tumbler, for otherwise if there is too much impact of the clothes on the door during the tumbling action, the door could be kicked opened. Consequently the back plate takes the brunt of the impact.

The clothes dryer is provided with a door 12 hingedly mounted at 14 to the housing of the dryer. The door has a center glass or window 16, which may be glass or plastic, which allows the user to view the basket 18 so as to know if the dryer is free for use, or when the drying cycle is complete.

Figure 2:
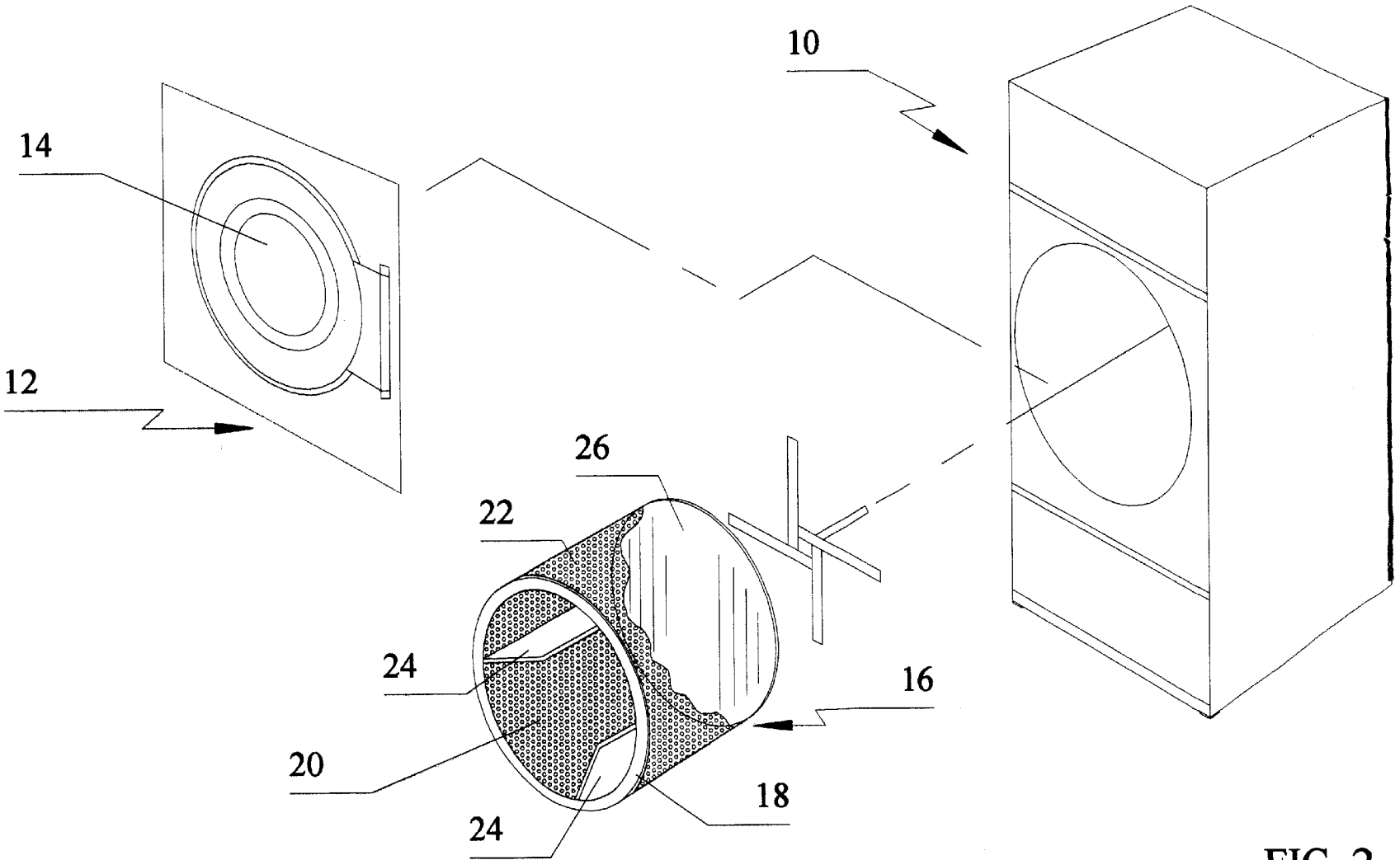
FIG. 2 is an exploded perspective view of a typical commercial clothes dryer having about a 75 pound capacity with a portion of the cylindrical side wall broken away to better illustrate the stainless steel backing sheet.
Figure 3:
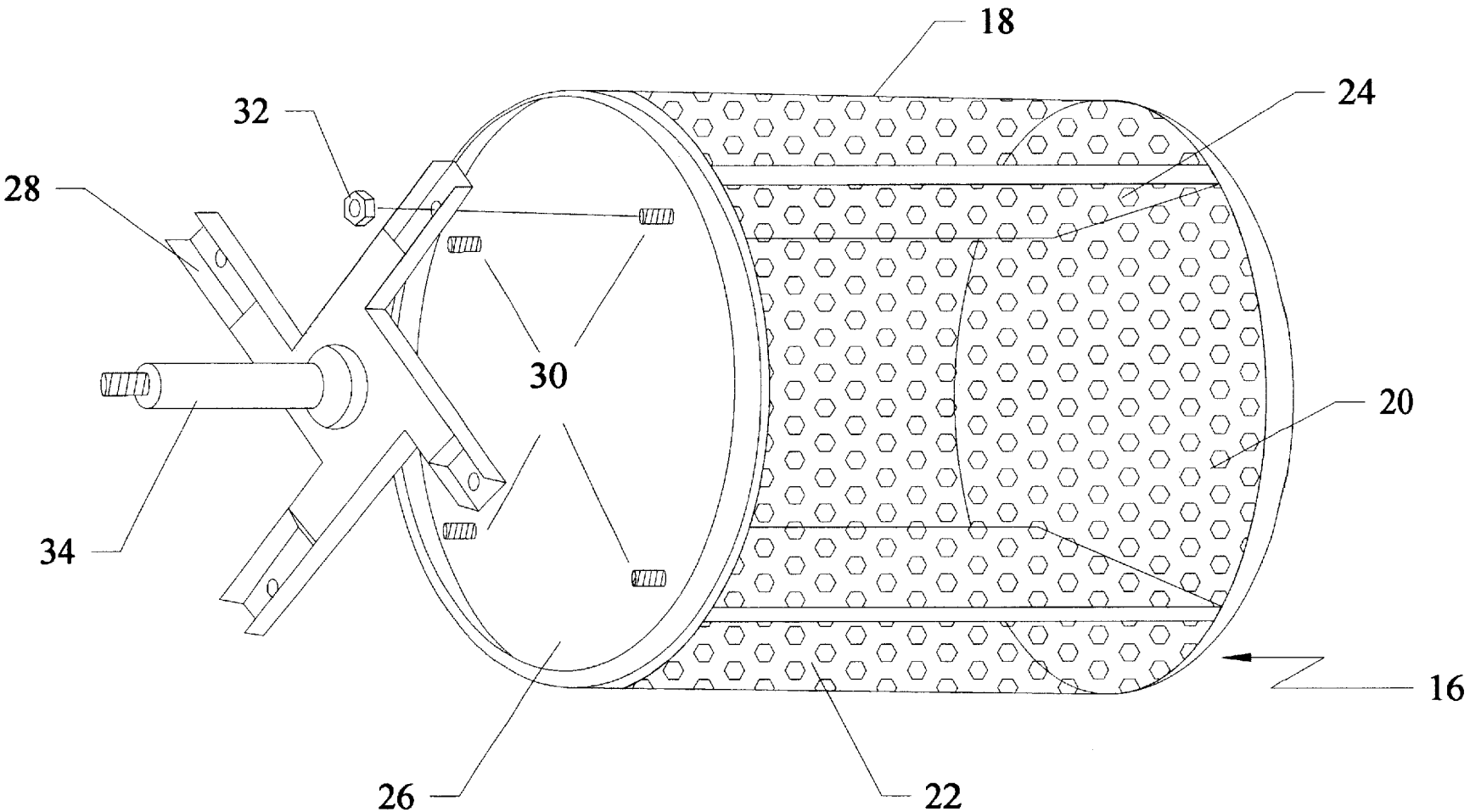
FIG. 3 is an exploded perspective view of the basket as viewed from the rear to better illustrate the connecting elements of the basket.

There is shown in FIGS. 2 and 3 the details of the cylinder 18, sometimes referred to in the art as the cylinder or drum, and it should be understood that the terms are used herein and in the appended claims as being synonymous. It will be observed that the tumbler 18 is open at one end 20, which is the forward or front end when arranged in the dryer. Thus, when positioned in the housing of the dryer, the door when opened provides direct access to the cylinder so that the cylinder can be loaded with clothes for drying or the clothes be removed when the drying cycle is completed. The side wall 22 of the cylindrical cylinder is reticulated, and because of this perforated wall or open network the total surface area of the metal forming the inside wall is small relative to the geometric area of the side wall. The wall is comprised of galvanized steel, such as cold rolled steel having a G-90 coating, and for a typical tumbler having, for example, a 50 pound capacity, the zinc coating is about 0.90 oz. Per square foot, but these specifications can vary somewhat depending on such factors as size of the cylinder, anticipated amount of use, and type of use.

The interior of the tumbler 18 is provided with a plurality of vanes or ribs 24, typically about four per cylinder. The vanes or ribs 24 are radially disposed so as to extend inwardly from the wall for a short distance of about three to four inches. The vanes facilitate the tumbling of the clothes. The vanes also are made of galvanized steel, and the coating usually is of the same type and gage as that for the wall.

As explained above, the tumbler 18 is arranged horizontally in the housing so that the open end 20 is adjacent the door 12. The opposite end or far end of the cylinder is provided with a solid sheet backing 26 made of stainless steel having a mirror-like finish. It will be observed that the backing is a unitary body, and not perforated as in the case of the side wall. Thus, the backing has a surface area larger than the interior surface of the side wall of the of the tumbler. Because of this difference in surface area and because of the mirror-like finish of the backing, the eye will focus immediately on the backing, which to the consumer or end user, enhances the aesthetic appeal. Still further, the stainless steel backing has superior heat resistant properties as compared to steel or galvanized steel. This factor is significant because the clothes dryer is operated at a relatively high temperature. In addition, the stainless steel is more corrosion resistant relative to steel ot galvanized steel. Strong or harsh chemicals are typically used in the laundering of clothes, and all too frequently these chemicals are not adequately rinsed from the clothes prior to being placed in the dryer. These chemicals attack the steel, which can be aggravated by the high operating temperatures. As explained above, it is advisable to elevate the front end of the dryer, and as a consequence, the backing receives the brunt of the impact. However, the unique properties of the stainless steel will better resist any deterioration.

The stainless steel backing 26, which is essentially the same diameter as the cylinder 18, is affixed to the marginal edge of the cylindrical bucket by any suitable means such as by welding, crimping, or the like, or by a combination of these means. The stainless steel plate should contain at least about 12 percent by weight chromium, and more preferably, at least about 14 to 18 weight percent. The amount of chromium can vary depending largely on such factors as the properties sought or considered desirable for that particular end use, and on other alloying elements, such as nickel, The plate should have a thickness of about 22 gauge, but the plate must be of sufficient thickness to withstand the impact normally encountered with a dryer. It is important that the plate exhibit high reflectivity or a mirror finish, which is achieved by polishing and bug, preferably to leave the surface free of grit lines. I have found a particularly useful stainless steel plate, for a gas fired dryer utilizing a bucket having a 50 pounds capacity, is a 430 bright annealed stainless steel contain about 14 to 18 weight percent chromium, having a gage of about 22, and has been polished to a mirror finish.

In order to rotate the cylinder 18, a spider assembly 28 is attached to the back of the bucket by any appropriate means. As illustrated in the drawings, the rear of the back plate 26 has a plurality of threaded tie rods 30, and on assembly the spider is attached with threaded bolts 32. A spindle or shaft 34 extends outwardly from the spider for insertion into the chuck of a motor for rotating the tumbler.

It will be observed that by reason of my invention, the dryer bucket provides several advantages, including an improved aesthetic appearance. Most significantly, the bucket with a galvanized steel cylindrical wall and stainless steel backing exhibits superior properties, most notably temperature resistance and corrosion resistance, which is important for a dryer because the backing plate receives the brunt of the impact. Further, it should be understood that the foregoing detailed description has been given for clearness of understanding only, and no unnecessary limitations should be understood therefrom, as modifications will be obvious to those skilled in the art.

What is claimed is:

1. A clothes dryer comprising, a housing; a substantially horizontally disposed cylinder arranged in said housing so as to be rotatable about its center longitudinal axis, said cylinder having a reticulated wall and a plurality of radially disposed vanes extending from the interior of the wall, and formed of a galvanized steel; said tumbler having a forwardly disposed open end, and an oppositely disposed closed end with a stainless steel sheet having a substantially mirror finish as viewed from the forward end; said housing being inclined so as to be elevated at the forward end relative to the back end; and a door hingedly mounted to said housing to allow access to said cylinder at said open end.

2. A clothes dryer according to claim 1 wherein said stainless steel sheet comprises at least about 12 percent by weight chromium.

3. A clothes dryer according to claim 1 wherein said stainless steel sheet comprises at least about 14 to 18 percent by weight chromium.

4. A clothes dryer according to any one of claims 1, 2 or 3 where said stainless steel sheet is a 430 bright annealed stainless steel and is about 22 gauge.

* * * * *